United States Patent [19]

Wiedemann et al.

[11] Patent Number: 4,725,520

[45] Date of Patent: Feb. 16, 1988

[54] ELECTROPHOTOGRAPHIC RECORDING MATERIAL

[75] Inventors: Wolfgang Wiedemann, Geisenheim-Johannisberg; Hans-Matthias Deger, Hofheim; Dieter Guenther, Kelkheim, all of Fed. Rep. of Germany

[73] Assignee: Hoechst Aktiengesellschaft, Fed. Rep. of Germany

[21] Appl. No.: 916,652

[22] Filed: Oct. 8, 1986

[30] Foreign Application Priority Data

Oct. 8, 1985 [DE] Fed. Rep. of Germany ..... 3535838

[51] Int. Cl.[4] ..... G03G 5/06; G03G 5/14

[52] U.S. Cl. ..... 430/58; 430/76; 430/77; 430/78

[58] Field of Search ..... 430/58, 59, 76, 77, 430/78

[56] References Cited

U.S. PATENT DOCUMENTS

| | | | |
|---|---|---|---|
| 3,879,200 | 4/1975 | Pregensburger et al. | 430/78 X |
| 3,992,205 | 11/1976 | Wiedemann et al. | 430/78 X |
| 4,429,029 | 1/1984 | Hoffmann et al. | 430/58 X |
| 4,556,622 | 12/1985 | Neumann et al. | 430/58 |
| 4,650,737 | 3/1987 | Wiedemann | 430/77 X |
| 4,666,812 | 5/1987 | Wiedemann et al. | 430/78 |

FOREIGN PATENT DOCUMENTS 1416603 12/1975 United Kingdom .

*Primary Examiner*—Roland E. Martin

*Attorney, Agent, or Firm*—Schwartz, Jeffery, Schwaab, Mack, Blumenthal & Evans

[57] ABSTRACT

An electrophotographic recording material comprising an electrically conducting layer support, an optional insulating intermediate layer, a photoconductive layer comprising at least one dyestuff as charge carrier-generating compound, and a layer containing a binder and photoconductor as charge-transport compound contains, as dyestuff in the photoconductive layer, a benzo-benzimidazo[1,2a]-quinoline derivative, preferably one represented by the formula Use of the dyestuff, in combination with a wide variety of photoconductors and binders, yields materials with excellent electrophotographic properties.

13 Claims, 7 Drawing Figures

ELECTROPHOTOGRAPHIC RECORDING MATERIAL

BACKGROUND OF THE INVENTION

The present invention relates to an electrophotographic recording material comprising an electrically conducting layer support, an optional insulating intermediate layer, a photoconductive layer comprising at least one layer, said photoconductive layer comprising a charge carrier-generating dyestuff, a photoconductor as charge-transport compound, a binder and customary additives. The present invention relates in particular to a recording material comprising an electrically conducting layer support; an optional insulating intermediate layer; a dyestuff layer containing a charge carrier-generating dyestuff; and an organic photoconductor layer containing a charge-transport compound.

The recording material of the present invention is especially suitable for a lithographic printing form which can be produced by electrophotographic means, or for printed circuits comprising a suitable electrically conducting layer support, and a photoconductive layer which contains alkali-soluble binders.

The use of dyestuffs as charge carrier-generating compounds in organic photoconductor layers is known (see, e.g., German Pat. No. 2,239,923, corresponding to British Pat. No. 1,416,603; German Pat. No. 2,246,255, corresponding to U.S. Pat. No. 3,989,520; and German Offenlegungsschrift No. 2,314,051, corresponding to U.S. Pat. No. 3,972,717). The known dyestuffs possess good photosensitivities which are, for instance, in the region from 420 to 650 nm.

SUMMARY OF THE INVENTION

It is an object of the present invention to provide new dyestuffs which, with good photosensitivity in photoconductive systems applied in double-layer or monolayer arrangements, can be combined with a wide variety of charge-transport compounds, binders and additives to form highly light-sensitive materials.

In accomplishing the foregoing object, there has been provided, in accordance with one aspect of the present application, an electrophotographic recording material comprising an electrically conducting layer support, an optional insulating intermediate layer, a photoconductive layer containing, in at least one layer, a dyestuff as charge carrier-generating compound, a binder and a photoconductor as charge-transport compound, wherein the dyestuff comprises a benzo-benzimidazo[1,2-a]quinoline derivative. In a preferred embodiment, the dyestuff contained in the photoconductive layer comprises a compound represented by the formula

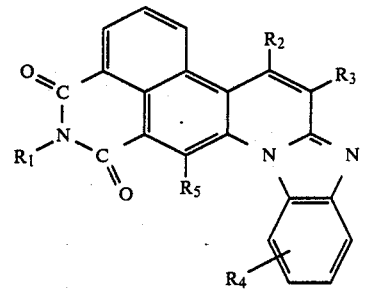

where $R_1$=hydrogen or a ($C_1$–$C_4$) alkyl group, which is unsubstituted or substituted by halogen, such as chlorine or bromine, and/or by at least one ($C_1$–$C_4$) alkoxy group; or is an unsubstituted or substituted cycloalkyl or phenyl group, in particular methyl;

$R_2$=hydrogen, a hydroxy group, a ($C_1$–$C_4$) alkoxy group, a cyano group or —COOR, with R denoting hydrogen or ($C_1$–$C_4$) alkyl;

$R_3$=a sulfophenyl group, a cyano group, an acetyl group, —COOR with R having the meaning described above, a benzoxazolyl group, a benzimidazolyl, optionally an N-methylbenzimidazolyl, group, in particular a benzthiazolyl group or cyano groups;

$R_4$=hydrogen or halogen, such as chlorine or bromine, and $R_5$=hydrogen, a cyano group or —COOR, with R having the meaning described above.

Other objects, features and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
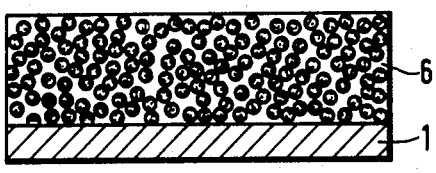
FIGS. 1–5 are schematic representations, in cross-sectional perspective, of different recording materials within the present invention.

It has been discovered that the dyestuffs of the present invention possess excellent electrophotographic properties as charge carrier-generating compounds. It has also been found that these dyestuffs can be used to produce good photosensitive recording materials with many organic photoconductors and, especially, with a wide variety of binders, both in double-layer and in mono-layer arrangements wherein the dyestuff is dispersely distributed.

The preparation of the dyestuffs according to the present invention is known (German Offenlegungsschrift No. 2,625,518, corresponding to U.S. Pat. No. 4,077,961).

The structure of electrophotographic recording materials within the present invention is described diagrammatically by reference to the attached FIGS. 1 to 5. Element 1 in each drawing is the electrically conducting layer support, element 2 is the charge carrier-generating dyestuff layer, and element 3 is the charge-transport layer. Element 4 is the insulating intermediate layer, and each layer which represents a charge carrier-generating dyestuff layer in dispersion is designated as element 5. Element 6 is a photoconductive mono-layer comprising dispersely-distributed dyestuff, photoconductor and binder.

Aluminum foil or, if appropriate, transparent polyester film which is coated with aluminum by vapor deposition or which is clad with aluminum, is preferably used as an electrically conducting layer support. But any other support material rendered sufficiently conductive (for example, by means of carbon black or the like) can also be used as a layer support. The photoconductor layer can also be disposed on a drum, on flexible endless belts made, for example, from nickel or steel, etc., or on plates.

Materials that are conventionally used for the electrophotographic production of printing forms, such as aluminum, zinc, magnesium and copper plates and multimetal plates, can also be used as support materials in accordance with the present invention. Surface-finished aluminum foils have proved especially successful in this regard. The surface finishing comprises a mechanical or electrochemical roughening or graining, and, if appropriate, a subsequent anodic oxidation and treatment with polyvinyl phosphonic acid, as disclosed by German Offenlegungsschrift No. 1,621,478 (corresponding to U.S. Pat. No. 4,153,461).

The introduction of an insulating intermediate layer and, optionally, also of a thermally, anodically or chemically generated aluminum oxide intermediate layer (see element 4 in FIG. 3), has the objective of reducing injection of charge carrier in the dark from the metal into the photoconductor layer. On the other hand, the intermediate layer should not prevent charge flow during the exposure process. The intermediate layer thus acts as a barrier layer and, in addition, serves to improve the adhesion, if necessary, between the layer support surface and the dyestuff film or photoconductor film. For the production of printing forms, the intermediate layers should be soluble in aqueous-alkaline or alcoholic-alkaline solutions.

Various natural or synthetic resin binders can be used for the intermediate layer, but those materials are preferable that adhere well to a metal surface, especially to an aluminum surface, and undergo little dissolution when other films are applied subsequently. These preferred materials include polyamide resins, polyvinyl alcohols, polyvinyl-phosphonic acid, polyurethanes, polyester resins and binders specifically soluble in alkali, such as styrene/maleic acid anhydride copolymers.

The thickness of organic intermediate layers can be up to 5 μm, and that of an aluminum oxide intermediate layer is generally in the range of 0.01 to 1 μm.

The dyestuff layer 2 or 5 of the present invention (see FIGS. 2 to 5) has the function of a charge carrier-generating layer. The dyestuff used in this context determines, by means of its absorption characteristics, the spectral photosensitivity of the photoconductive system.

The application of a homogeneous, densely packed dyestuff layer is preferably achieved by vapor deposition of the dyestuff on the layer support in vacuo. As a function of the vacuum level, the dyestuff can be deposited by evaporation without decomposing under the conditions of $1.33\times10^{-6}$ to $10^{-8}$ bar and a heating temperature of 240° to 270° C. At the same time the temperature of the layer support is below 50° C. The resulting layers contain densely packed dyestuff molecules. This approach provides an advantage over all other possibilities of generating very thin homogeneous dyestuff layers in that an optimum charge generation rate can be obtained. Thus, the extremely finely dispersed distribution of the dyestuff makes possible a high concentration of activated dyestuff molecules which inject charges into the charge-transport layer. In addition, charge transport through the dyestuff layer is not impeded, or is only slightly impeded, by binders.

An advantageous layer-thickness range for the vapor-deposited dyestuff is between 0.005 and 3 μm. Particularly preferred is a thickness range between 0.05 and 1.5 μm, since in this case the adhesive strength and homogeneity of the vapor-deposited dyestuff are particularly favorable.

Apart from vapor deposition of the dyestuff, a uniform dyestuff thickness can also be achieved by other coating techniques. These techniques include application by mechanically rubbing the superfinely powdered material into the electrically conducting layer support, and application by electrolytic or electrochemical processes or by an electrostatic spraying method.

Figure 4:
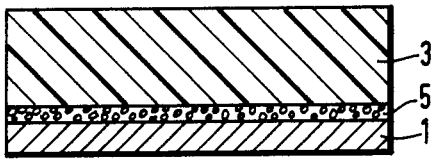
Figure 5:
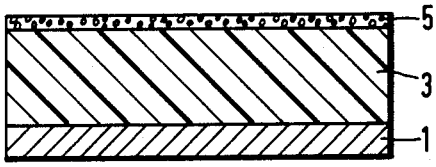

In combination with, or in lieu of, an intermediate layer, homogeneous dyestuff layers providing good coverage and having thicknesses on the order of 0.05 to 3 μm can also be prepared by grinding the dyestuff together with binders, particularly with cellulose nitrates and/or crosslinking binder systems, for example, acrylic resins crosslinkable with polyisocyanate, reactive resins such as epoxides and DD lacquers. The resulting dyestuff dispersions are then coated to form element 5, as shown in FIGS. 4 and 5. Suitable binders include polystyrene, styrene maleic acid anhydride copolymers, polymethacrylates, polyvinyl acetates, polyurethanes, polyvinylbutyrals, polycarbonates and polyesters, and also mixtures thereof.

The dyestuff/binder ratio can vary within wide limits, but preferred dyestuff primer coatings have a dyestuff proportion of over 50% and, correspondingly, a high optical density.

Another possibility involves the preparation of a photoconductor layer according to FIG. 1 in which the charge generating centers (dyestuffs) are finely dispersed in the charge-transport layer medium. This arrangement has the advantage over a double layer of a simpler manufacture. It is especially suitable for the preparation of lithographic printing forms. In this case the proportion of dyestuff in the photoconductor layer is preferably about 30%. The layer thickness of such arrangements is preferably 2 to 10 μm.

If a p-type transport compound is used, the inverse arrangement of the charge carrier-generating layer 5 in FIG. 5 on the charge-transporting layer 3 produces photoconductor double layers which, when positively charged, possess a high photosensitivity.

Organic compounds that have an extended $\pi$-electron system are particularly suitable as the charge-transport material. These compounds include both monomeric and polymeric aromatic or heterocyclic compounds. Particularly preferred are those monomers that have at least one tertiary amino group and/or a dialkylamino group.

Heterocyclic compounds like oxadiazole derivatives, as mentioned in the German Pat. No. 1,058,836 (corresponding to U.S. Pat. No. 3,189,447), have proved especially successful. These include, in particular, 2,5-bis(p-diethylaminophenyl)-1,3,4-oxadiazole. Unsymmetrical oxadiazoles, such as 5-[3-(9-ethyl)carbazolyl]-1,3,4-oxadiazole derivatives (U.S. Pat. No. 4,192,677), like 2-(4-dialkyl-aminophenyl)-5-[3-(9ethyl)carbazolyl]-1,3,4-oxadiazole, can also be used to advantage.

Other suitable monomeric compounds are arylamine derivatives (triphenylamine) and triarylmethane derivatives (German Pat. No. 1,237,900), for example, bis(4-diethyl-amino-2-methylphenyl)phenylmethane; more highly condensed aromatic compounds such as pyrene; and benzo-condensed heterocyclic compounds (e.g., benzoxazole derivatives). Also suitable are pyrazolines, for example, 1,3,5-triphenyl-pyrazolines and imidazole derivatives (see German Pat. No. 1,060,714 and No. 1,106,599, corresponding to U.S. Pat. No. 3,180,729 and British Pat. No. 938,434, respectively). To these belong also triazole, thiadiazole and, especially, oxazole derivatives, like 2-phenyl-4-(o-chlorophenyl)-5-(p-diethylaminophenyl)oxazole, as disclosed in the German Pat. No. 1,060,260; No. 1,299,296 and No. 1,120,875 (corresponding to U.S. Pat. No. 3,112,197, British Pat. No. 1,016,520 and U.S. Pat. No. 3,257,203, respectively).

Furthermore, 4-chloro-2-(4-dialkylaminophenyl)-5-aryloxazole derivatives represented by the following formula are of great interest:

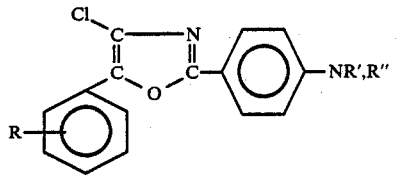

where

R is hydrogen, halogen, alkyl or alkoxyl and

R', R'' are alkyl.

Their preparation is known from German Offenlegungsschrift No. 2,844,394.

Compounds that have proved useful for charge transport further include hydrazone derivatives represented by the following formula:

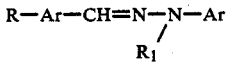

where

R=is hydrogen, halogen, alkyl, alkoxyl or a dialkylamino group and $R_1$=is alkyl or aryl, such as benzyl.

Hydrazone derivatives of this sort are disclosed by U.S. Pat. No. 4,150,987 and by German Offenlegungsschriften No. 2,941,509, No. 2,919,791 and No. 2,939,483 (corresponding to U.S. Pat. No. 4,338,388, U.S. Pat. No. 4,278,747 and British Pat. No. 2,034,493, respectively).

Figure 2:
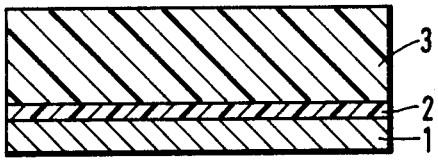
Figure 3:
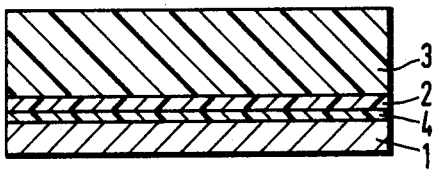

Formaldehyde condensation products with various aromatic compounds, for example, condensates derived from formaldehyde and 3-bromopyrene, have proved suitable as polymers (German Offenlegungsschrift No. 2,137,288, corresponding to U.S. Pat. No. 3,842,038). In addition, polyvinylcarbazole and copolymers containing at least 50% vinylcarbazole component can be employed as transport polymers, according to the present invention, to yield a good photosensitivity, for example, in a double-layer arrangement (FIGS. 2 to 4).

Without the dyestuff layer the charge-transport layer 3 has virtually no photosensitivity in the visible region (420 to 750 nm). If negative charging is intended, the charge-transport layer preferably comprises a mixture of an electron-donor compound (organic photoconductor) with a binder. The layer is preferably transparent, but this is not necessary if a transparent conducting layer support is used. The film 3 has a high electrical resistance of more than $10^{12}\Omega$. In the dark, it prevents scattering of the electrostatic charge; upon exposure it transports the charges generated in the dyestuff layer.

In addition to the charge-generation and charge-transport materials described, the binder added influences mechanical performance, such as abrasion, flexibility, film formation and adhesion, and also to a certain extent electrophotographic behavior, such as photosensitivity, residual charge and cyclic performance.

Polyester resins, polyvinyl chloride/polyvinyl acetate copolymers, alkyd resins, polyvinyl acetates, polycarbonates, silicone resins, polyurethanes, epoxy resins, poly(meth)acrylates and their copolymers, polyvinylacetals, polystyrenes and styrene copolymers, and cellulose derivatives like cellulose acetobutyrates are used as binder materials. Also successfully used are thermally crosslinking binder systems, such as reactive resins which are composed of an equivalent mixture of polyesters polyethers containing hydroxyl groups and polyfunctional isocyanates; acrylate resins which can be crosslinked with polyisocyanate; melamine resins and unsaturated polyester resins. The use of high-viscosity cellulose nitrates is especially preferred because of the good photosensitivity, flash sensitivity and high flexibility obtained with these compounds.

In addition to the film-forming and electrical properties, and also strength of adhesion to the layer support material when used for printing forms or printed circuits, solubility properties in particular play a special role in the choice of binders. For practical purposes particularly suitable binders are those that are soluble in aqueous or alcoholic solvent systems, optionally in the presence of added acid or alkali. Accordingly, suitable binders are high-molecular substances carrying groups that render them alkali-soluble. Such groups are, for example, acid anhydride, carboxyl,. phenol, sulfonic acid, sulfonamide and sulfonimide groups.

Copolymers containing anhydride groups can be used with especially good success. Especially suitable are copolymers of ethylene or styrene and maleic acid anhydride or maleic acid half-esters. Phenolic resins have also proved very successful.

Copolymers of styrene, methacrylic acid and methacrylic acid esters can also be used as alkali-soluble binders (German Offenlegungsschrift No. 2,755,851). In particular, a copolymer of 1 to 35% styrene, 10 to 40% methacrylic acid and 35 to 83% n-hexyl methacrylate is used. Outstandingly suitable is a terpolymer of 10% styrene, 30% methacrylic acid and 60% n-hexyl methacrylate. Polyvinyl acetates (PVAc), particularly copolymers of PVAc and crotonic acid, can also be used.

The binders used can be employed alone or in combination.

The mixing ratio of the charge-transporting compound to the binder can vary in the present invention. But the requirement for maximum photosensitivity (favoring as high a proportion of charge-transport compound as possible) and the requirements for avoiding crystallizing out and, also, for increasing the flexibility (favoring as high a proportion of binders as possible) set relatively definite limits on the mixing ratio. A mixing ratio of approximately 1:1 parts by weight has generally proved preferable, but ratios between 4:1 and 1:4 are also suitable. If polymeric charge-transport compounds such as bromopyrene resin and polyvinylcarbazole are used, binder proportions around or below 30% are suitable.

The particular requirements imposed by a copying device on the electrophotographic and mechanical properties of recording material can be met, over a wide range, by adjusting the layers of the present invention, for example, by varying the viscosity of the binders and proportion of the charge-transporting compound, respectively.

In addition to its transparency, the thickness of the charge-transporting layer is an important parameter for achieving optimum photosensitivity: film thicknesses between approximately 2 and 25 μm are generally used. A thickness range of 3 to 15 μm has proved especially advantageous. If the mechanical requirements and the electrophotographic parameters of the charging and development stations in a copying apparatus permit, however, the specified limits can be extended upward or downward from case to case.

Typical additives for use in the present invention include flow-control agents like silicone oils, wetting agents, in particular non-ionogenic substances, and plasticizers of various composition, such as those based on chlorinated hydrocarbons and those based on phthalic acid esters. If necessary, conventional sensitizers and/or acceptors can also be added to the charge-transporting layer, but only to the extent that the optical transparency of the layer is not substantially impaired.

The invention is described in more detail by reference to the following examples, which are illustrative only.

EXAMPLE 1

Four samples of support material comprising polyester film coated with aluminum by vapor deposition were each coated under mild conditions, by vapor deposition at $1.33\times10^{-7}$–$10^{-8}$ bar, with a dyestuff represented by one of the following formulas (1) to (4):

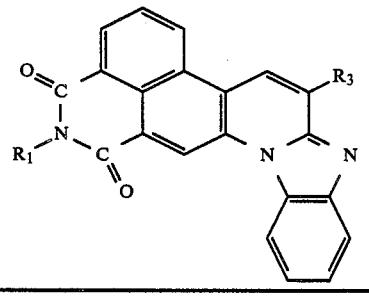

| | | |
|---|---|---|
| Formula (1) | $R_1 = CH_3$ | $R_3 = CN$ |
| Formula (2) | $R_1 = CH_3$ | $R_3 = -\underset{\underset{O}{\|}}{C}-CH_3$ |

-continued

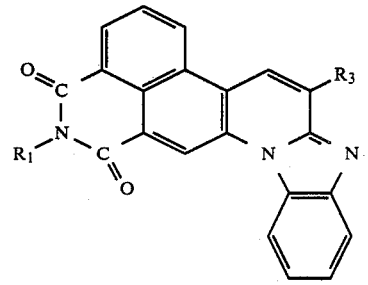

| | | |
|---|---|---|
| Formula (3) | $R_1 = CH_3$ | $R_3 =$ 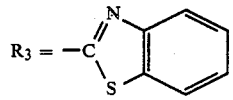 |
| Formula (4) | $R_1 = CH_3$ | $R_3 =$ 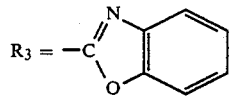 |

Each of the homogeneous, yellowish-orange colored dyestuff layers had a weight in the range from 125 to 150 mg/m².

A solution comprising equal parts by weight of 2,5-bis(4-diethylaminophenyl)-1,3,4-oxadiazole (To 1920) and a copolymer of vinyl chloride and vinyl acetate (Hostaflex ®M131, made by Hoechst AG) in tetrahydrofuran was applied to each sample. After drying, the resulting layer thickness was approximately 8 μm.

Photosensitivity was measured in the following manner: To determine the light decay curves, the test sample was moved on a rotating disk through a charge device to an exposure station, where it was continuously illuminated with an XBO 150 xenon lamp, or alternatively, a halogen/tungsten lamp (150 W). A heat-absorption glass and a neutral filter were placed in front of the lamp. The light intensity in the measurement plane ranged from 30 to 50 μW/cm², or from 5 to 10 μW/cm², and was measured with an optometer immediately after or during the determination of the light decay curve. The charge level and the photo-induced light decay curve were recorded with an oscillograph through a transparent probe by means of an electrometer. Each photoconductor layer was characterized by the charge level ($U_o$) and the time ($T_{1/2}$) in which half the charge ($U_o/2$) was reached. The product of $T_{1/2}$ (s) and the measured light intensity I (μW/cm²) was the half-value energy $E_{1/2}$(μJ/cm²).

The electrophotographic parameters thus determined for each of the above-described samples are tabulated below:

| Dyestuff No. | (−) $U_o$ (V) | $E_{\frac{1}{2}}$ (μJ/cm²) |
|---|---|---|
| 1 | 450 | 2.36 |
| 2 | 390 | 5.70 |
| 3 | 490 | 1.56 |
| 4 | 360 | 2.30 |

EXAMPLE 2

Vapor-deposited layers having a weight per unit area of 125 mg/m² were prepared, as described in Example 1, using a dyestuff represented by formula 3. Those layers were coated with transparent layers having a thickness of approximately 8 μm and comprising 5 parts by weight of To 1920 and, respectively, one of the following binders:

(a) polyurethane (40 parts of Desmolac ®2100, Bayer AG)/cellulose nitrate (10 parts of CN according to standard type 4E, DIN 53,179),
(b) polycarbonate (50 parts of Makrolon ®2405, Bayer AG), and
(c) polyvinylbutyral (50 parts of Mowital ®B30H, Hoechst AG).

The measurement of photosensitivity according to Example 1 yielded the following values:

| Layer | (−) $U_o$ (V) | $E_{\frac{1}{2}}$ (μJ/cm²) |
|---|---|---|
| a | 420 | 1.02 |
| b | 530 | 3.03 |
| c | 580 | 2.85 |

Figure 6:
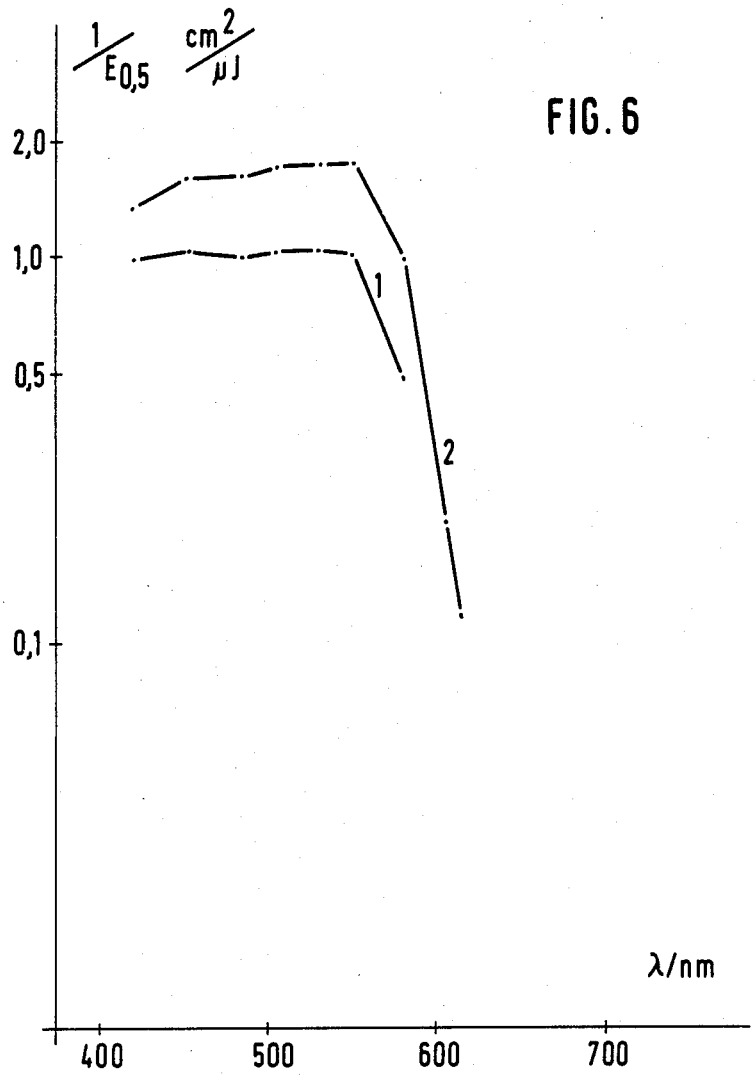
FIGS. 6 and 7 are graphs depicting the spectral photosensitivity of two embodiments of the present invention.

The spectral photosensitivity of the double layers thus prepared was determined following the method specified in Example 1, with the interposition of filters in front of the lamp. For negative charging (500–550 V), the half-value time ($T_{1/2}$ in msec) was thus determined for the respective wavelength range by exposure. The spectral photosensitivity curve was obtained by plotting the reciprocal half-value energy $1/E_{1/2}$(cm²/μJ) against the wavelength λ (nm). The half-value energy $E_{1/2}$(μJ/cm²) denotes that light energy that has to be irradiated in order to discharge the layer to half the initial voltage $U_o$. FIG. 6 (curve 1) shows the spectral photosensitivity of the double layer (a) that was determined by charging to approximately −570 V and exposure by means of a xenon lamp.

EXAMPLE 3

A vapor-deposited layer of formula 3 dyestuff, having a weight of 285 mg/m², was coated with a solution comprising 65 parts of To 1920 and 35 parts of cellulose nitrate of standard type 4E in tetrahydrofuran to a thickness of approximately 7 μm after drying.

The photosensitivity was determined as described in Example 1:

| Dyestuff No. | (−) $U_o$ (V) | $E_{\frac{1}{2}}$ (μJ/cm²) | I (μW/cm²) |
|---|---|---|---|
| 3 | 620 | 0.92 | 27 xenon XBO 150 |
| | 380 | 0.65 | 6.6 halogen/T lamp |

The spectral photosensitivity was determined with a negative charge of approximately 600 V and with exposure to a xenon XBO lamp (FIG. 6, curve 2).

EXAMPLE 4

A polyester layer support coated with aluminum by evaporation was coated homogeneously, by vapor deposition at $10^{-7}$ to $10^{-8}$ bar, with the dyestuff represented by formula 1 to a film thickness corresponding to 265 mg/m² (samples a, b and e) and 210 mg/m² (samples c and d), respectively. The following charge-transport layers were applied, respectively, to a thickness of approximately 8 μm to the resulting vapor-deposited red dyestuff layer, which had good coverage:

(a) 2-(4-diethylaminophenyl)-4-chloro-5-(4-methoxyphenyl)-oxazole and polycarbonate,
(b) 2-(phenyl)-4-(2-chlorophenyl)-5-(4-diethylaminophenyl)-oxazole and polycarbonate,
(c) photoconductor as (b) and polyester resin (Dynapol ®L 206 made by Dynamit Nobel),
(d) 1,3,5-triphenylpyrazoline and polycarbonate, and
(e) To 1920 and polycarbonate.

In each case, the mixing ratio of photoconductor compound to binder was 1:1.

The photosensitivity measured as in Example 1 (halogen/tungsten lamp, I∼6.6 μW/cm²) yielded the following values:

| Layer | (−) $U_o$ (V) | $E_{\frac{1}{2}}$ (μJ/cm²) |
|---|---|---|
| a | 545 | 1.69 |
| b | 530 | 2.09 |
| c | 470 | 2.21 |
| d | 540 | 2.46 |
| e | 430 | 1.26 |

EXAMPLE 5

The following photoconductive compounds, in a weight ratio of 1:1 with polycarbonate, were coated onto a vapor-deposited layer of formula 1 dyestuff with a thickness of 265 mg/m² (samples a and b) and 210 mg/m² (sample c):

(a) 9-ethylcarbazolyl-3-aldehyde-N-methyl-N-phenylhydrazone,
(b) 9-ethylcarbazolyl-3-aldehyde-N,N-diphenylhydrazone, and
(c) bis(4-diethylamino-2-methylphenyl)phenylmethane.

After drying the layer thickness was 8–9 μm, and the measurement of the photosensitivity (halogen/tungsten lamp, I∼6.6 μW/cm²) yielded the following values:

| Layer | (−) $U_o$ (V) | $E_{\frac{1}{2}}$ (μJ/cm²) |
|---|---|---|
| a | 460 | 2.25 |
| b | 375 | 1.20 |
| c | 545 | 1.91 |

EXAMPLE 6

A vacuum-deposited, 150 mg/m²-thick layer of dyestuff represented by Example 4 was coated with a solution comprising 90 parts of polyvinylcarbazole (Luvican ®M170, BASF) and 10 parts of polyester resin (Adhesive 49.000 made by du Pont) in tetrahydrofuran to a thickness of 4 to 5 μm. The measured photosensitivity ($E_{1/2}$) was 3.06 μJ/cm² at (−) 320 V.

EXAMPLE 7

Samples of a vacuum-deposited layer of formula 4 dyestuff, each having a layer weight per unit area of 210 mg/m², were coated, respectively, with one of the following charge-transport layers in the weight ratio of 1:2:

(a) To 1920/polymethacrylate (PM 381),
(b) To 1920/copolymer of styrene and maleic acid anhydride (Scripset ®550 made by Monsanto),
(c) To 1920 (65 parts)/cellulose nitrate (35 parts),
(d) To 1920/vinyl chloride/vinyl acetate copolymer (Hostaflex ®M131)/polyester resin (Dynapol ®L 206), in a weight ratio of 50:25:25).

The photosensitivity values measured according to Example 1 were as follows:

| Layer | Thickness μm | (−) $U_o$ (V) | $E_{\frac{1}{2}}$ (μJ/cm²) |
|---|---|---|---|
| a | 8 | 430 | 1.93 |
| b | 8 | 450 | 1.66 |
| c | 10 | 480 | 1.19 |
| d | 9–10 | 440 | 1.74 |

Figure 7:
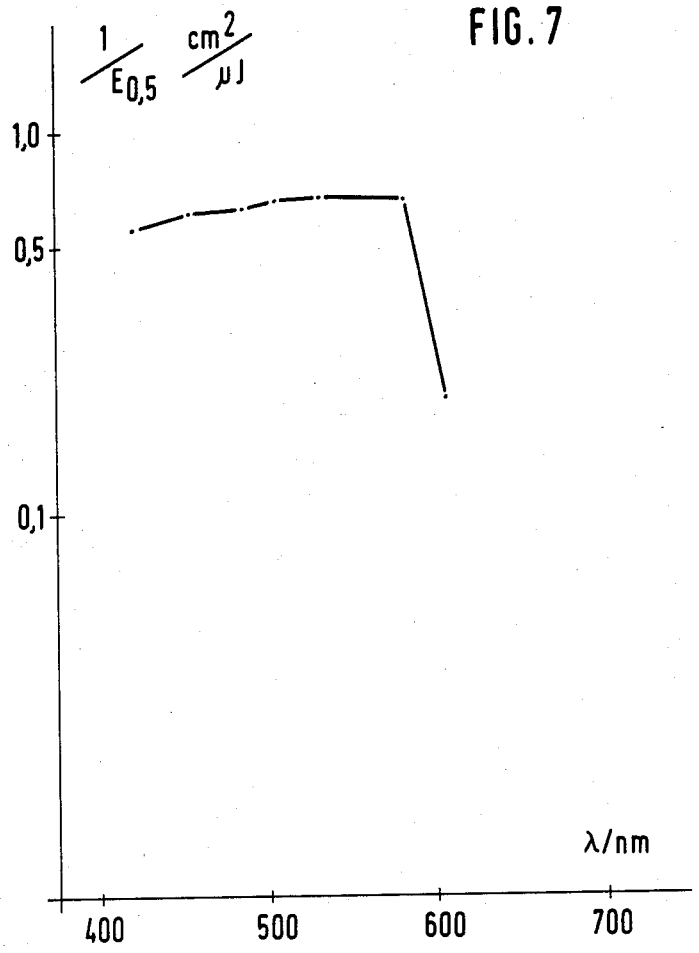

The spectral photosensitivity of layer (d) was measured in the negative-charging range of 720 to 760 V, according to Example 2 (FIG. 7).

EXAMPLE 8

Five parts of formula 1 dyestuff were added to a solution containing 45 parts of To 1920, 45 parts of a copolymer of styrene and maleic anhydride (Scripset ®550) and 5 parts of cellulose nitrate of standard type 4E in tetrahydrofuran, and the resulting mixture was very finely ground in a ballmill over the course of 2 hours. This dyestuff dispersion was then coated onto a wirebrushed aluminum foil (100 μm) to a thickness of approximately 8 μm.

The measurement of the photosensitivity according to Example 1 gave half-value energies of 11.5 and 11.9 μJ/cm² (halogen/tungsten lamp, I~6.5 μW/cm²) with positive and negative charging (400 V), respectively.

EXAMPLE 9

A mixture of 2 parts of dyestuff according to formula 3 and 1 part of cellulose nitrate of standard type 4E (DIN 53 179) in tetrahydrofuran was vigorously ground during approximately 3 hours in a ballmill. The finely dispersed solution was applied homogeneously to a thickness of approximately 150 mg/m², onto a polyester film coated with vapor-deposited aluminum, and then was dried.

The dyestuff-coated film was coated with a solution of 2 parts of To 1920 and 1 part of cellulose nitrate in tetrahydrofuran. After drying, the double-layer arrangement had a weight per unit area of 12.7 g/m². With charging to −410 V, the photosensitivity ($E_{1/2}$) was 8.9 μJ/cm² (halogen/tungsten lamp, I~6.8 μW/cm²).

What is claimed is:

1. An electrophotographic recording material comprising an electrically conducting layer support, a photoconductive layer containing at least one dyestuff as charge carrier-generating compound, and a layer containing a binder and a photoconductor as charge-transport compound, wherein said dyestuff comprises a benzo-benzimidazo[1,2a]-quinoline derivative.

2. The recording material as claimed in claim 1, further comprising an insulating intermediate layer provided between said conductive layer support and said photoconductive layer system.

3. The recording material as claimed in claim 1, wherein said dyestuff comprises a compound represented by the formula

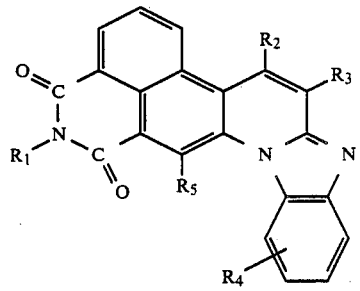

where $R_1$ is selected from the group consisting of hydrogen, a ($C_1$–$C_4$) alkyl group, a ($C_1$–$C_4$) alkyl group substituted by halogen or by a ($C_1$–$C_4$) alkoxy group, an unsubstituted or substituted cycloalkyl group and an unsubstituted or substituted phenyl group;

$R_2$ is selected from the group consisting of hydrogen, a hydroxy group, a ($C_1$–$C_4$) alkoxy group, a cyano group and a —COOR group, with R being hydrogen or ($C_1$–$C_4$) alkyl;

$R_3$ is selected from the group consisting of a sulfophenyl group, a cyano group, an acetyl group, a benzoxazolyl group, a benzimidazolyl group, a benzthiazolyl group and a —COOR group, with R being hydrogen or ($C_1$–$C_4$) alkyl;

$R_4$ is hydrogen or halogen and $R_5$ is selected from the group consisting of hydrogen, a cyano group and a —COOR group, with R being hydrogen or ($C_1$–$C_4$) alkyl.

4. The recording material as claimed in claim 3, wherein at least one of $R_1$ and $R_4$ is chlorine or bromine.

5. The recording material as claimed in claim 1, wherein said dyestuff is represented by the formula

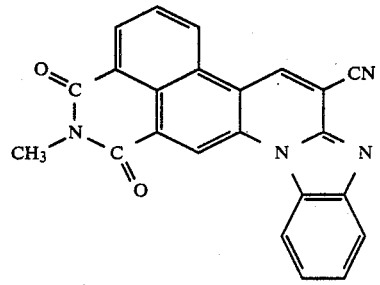

or

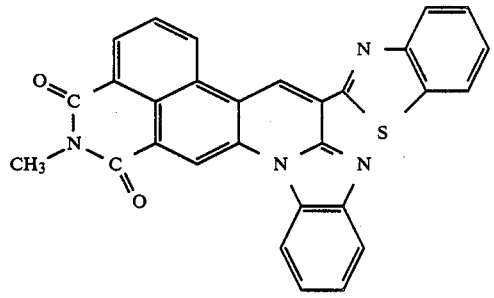

6. The recording material as claimed in claim 1, wherein said photoconductive layer consists essentially of said dyestuff.

7. The recording material as claimed in claim 1, wherein said photoconductive layer comprises a binder and said dyestuff dispersed in said binder.

8. The recording material as claimed in claim 7, wherein said photoconductive layer separates said layer support from said layer containing said charge-transport compound.

9. The recording material as claimed in claim 7, wherein said layer containing said charge-transport compound separates said layer support from said photoconductive layer.

10. An electrophotographic recording material comprising an electrically conducting layer support, and a photoconductive layer comprising a photoconductor, a binder and at least one dyestuff as charge-generating compound, wherein said dyestuff comprises a benzobenzimidazol[1,2a]-quinoline derivative.

11. The recording material as claimed in claim 10, wherein said dyestuff comprises a compound represented by the formula

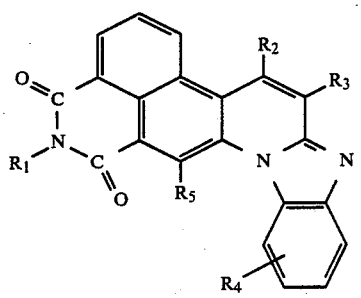

where $R_1$ is selected from the group consisting of hydrogen, a ($C_1$–$C_4$) alkyl group, a ($C_1$–$C_4$) alkyl group substituted by halogen or by a ($C_1$–$C_4$) alkoxy group, an unsubstituted or substituted cycloalkyl group and an unsubstituted or substituted phenyl group;

$R_2$ is selected from the group consisting of hydrogen, a hydroxy group, a ($C_1$–$C_4$) alkoxy group, a cyano group and a —COOR group, with R being hydrogen or ($C_1$–$C_4$) alkyl;

$R_3$ is selected from the group consisting of a sulfophenyl group, a cyano group, an acetyl group, a benzoxazolyl group, a benzimidazolyl group, a benzthiazolyl group and a —COOR group, with R being hydrogen or ($C_1$–$C_4$) alkyl;

$R_4$ is hydrogen or halogen and $R_5$ is selected from the group consisting of hydrogen, a cyano group and a —COOR group, with R being hydrogen or ($C_1$–$C_4$) alkyl.

12. The recording material as claimed in claim 10, wherein at least one of $R_1$ and $R_4$ is chlorine or bromine.

13. The recording material as claimed in claim 10, wherein said dyestuff is represented by the formula

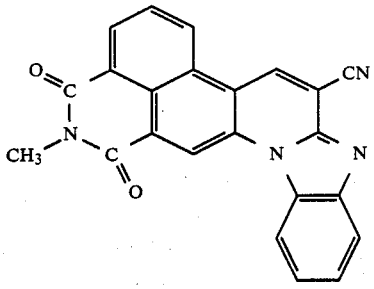

or

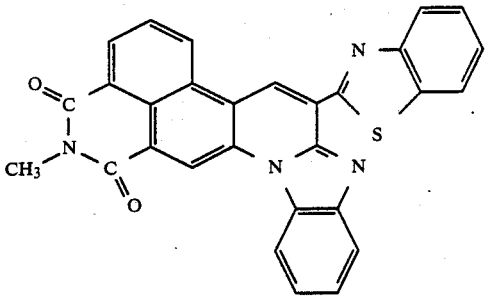

* * * * *